United States Patent [19]

Wixon

[11] Patent Number: 4,605,506

[45] Date of Patent: Aug. 12, 1986

[54] FABRIC SOFTENING BUILT DETERGENT COMPOSITION

[75] Inventor: Harold E. Wixon, New Brunswick, N.J.

[73] Assignee: Colgate-Palmolive Company, New York, N.Y.

[21] Appl. No.: 616,467

[22] Filed: Jun. 1, 1984

[51] Int. Cl.[4] ..... C11D 1/831; C11D 3/12; D06M 11/00; D06M 13/46

[52] U.S. Cl. ..... 252/8.75; 252/8.6; 252/174.24; 252/174.25; 252/550; 252/551; 252/554; 252/559; 252/DIG. 2; 252/DIG. 14; 252/8.8

[58] Field of Search ..... 252/8.6, 8.75, 174.21, 252/174.25, 174.24, 550, 551, 559, DIG. 2, DIG. 14, 8.8

[56] References Cited

U.S. PATENT DOCUMENTS

| | | | |
|---|---|---|---|
| 3,395,100 | 7/1968 | Fisher et al. | 252/8.8 |
| 4,144,226 | 3/1979 | Crutchfield et al. | 528/231 |
| 4,146,495 | 3/1979 | Crutchfield et al. | 252/132 |
| 4,204,052 | 5/1980 | Crutchfield et al. | 525/398 |
| 4,272,386 | 6/1981 | Draper et al. | 252/8.6 |
| 4,284,524 | 8/1981 | Gilbert | 252/99 |
| 4,315,092 | 2/1982 | Crutchfield et al. | 528/230 |
| 4,469,605 | 9/1984 | Ramachandran et al. | 252/8.7 |

FOREIGN PATENT DOCUMENTS 15024 9/1980 European Pat. Off. .

*Primary Examiner*—Prince E. Willis

*Attorney, Agent, or Firm*—Herbert S. Sylvester; Murray M. Grill; Norman Blumenkopf

[57] ABSTRACT

A fabric softening built detergent composition, often preferably in the form of a stable and pourable liquid, includes a detersive proportion of a synthetic organic detergent, such as anionic and/or nonionic detergent(s), a building proportion of polyacetal carboxylate builder for the detergent(s) and a fabric softening proportion of bentonite. The presence of the polyacetal carboxylate builder in the described compositions increases the fabric softening action of the bentonite during washing of laundry. In preferred liquid detergent compositions the bentonite helps to stabilize such liquids and inhibits separation of the polyacetal carboxylate builder particles, which are dispersed in the aqueous liquid medium.

Also within the invention are methods of simultaneously washing and softening fabric materials by washing them in wash waters containing the components of the described compositions, and then rinsing and drying. In further aspects of the invention an antistatic agent, such as dimethyl distearyl ammonium chloride, is present in a fabric softening composition and in the wash water to inhibit the development of electrostatic charges on the washed material and the resulting objectionable clinging of such materials together after drying.

11 Claims, No Drawings

FABRIC SOFTENING BUILT DETERGENT COMPOSITION

This invention relates to fabric softening built detergent compositions and to processes for washing and simultaneously softening fabric materials. More particularly, it relates to such compositions which comprise a synthetic organic detergent, a polyacetal carboxylate builder for such detergent and a fabric softening proportion of bentonite, and to washing processes in which the components of such composition are present in the wash water.

The use of synthetic organic detergents in detergent compositions is well known, as is the employment of builders for such detergents which help to improve the detersive function thereof and to make them more suitable for washing heavily soiled materials. In the comparatively recent past polyacetal carboxylates have been synthesized and it has been recommended that they be employed as builders in non-phosphate detergent compositions because of their exceptionally good building capacities and their environmental acceptability. Such builders do not contain phosphorus and they are hydrolyzable in acidic waste water solutions, so that they are decomposed therein, whereas they are satisfactorily stable and effective in the normal alkaline aqueous solutions employed for washing laundry. Bentonite is known to possess fabric softening properties and has been suggested for incorporation in detergent compositions so that the fabrics washed with such compositions will have a softer feel or hand than those washed with built detergent compositions that do not contain bentonite or other suitable fabric softener.

Although the various principal components of the present compositions (which components are also employed in the invented processes) had been suggested as constituents of detergent compositions and for use in washing processes, the present products and methods are novel, and possess characteristics that are highly beneficial and were not taught or suggested by the prior art. Thus, the combination of bentonite and polyacetal carboxylate builder with synthetic detergent results in a softening effect which is greater than that obtained with the synthetic detergent and bentonite alone, and the art does not indicate that the polyacetal carboxylate builders would have such an effect. Furthermore, when liquid detergents are made the bentonite helps to stabilize them by helping to maintain suspended the polyacetal carboxylate particles dispersed in the liquid medium, and at the same time the detergent, suspended particles and bentonite do not react objectionably in liquid media, as other fabric softening compounds, detergent and polyacetal carboxylate could react. Thus, the combination of components in the present compositions leads to significantly improved products which are novel and unobvious from the prior art.

In accordance with the present invention a fabric softening built detergent composition comprises a detersive proportion of a synthetic organic detergent or a mixture of such detergents, a building proportion of a polyacetal carboxylate builder for such detergent(s) and a fabric softening proportion of bentonite. Preferably such a detergent composition is a liquid detergent which comprises 10 to 25% of an alkali metal anionic detergent salt which is a sulfated and/or sulfonated detergent having a higher linear alkyl or higher linear acyl lipophilic moiety, 0 to 5% of a nonionic detergent which is a condensation product of a higher fatty alcohol of 10 to 18 carbon atoms and 3 to 20 ethylene oxide groups, 15 to 35% of an alkali metal polyacetal carboxylate which is linear, includes about 30 to 120 polyacetal carboxylate units in the chain thereof and is of a calculated weight average molecular weight in the range of about 3,000 to 20,000, 5 to 20% of bentonite which is of a swelling capacity of at least 6 ml./g. and 30 to 70% of a liquid solvent and/or dispersing medium. Also within the invention are processes for washing and softening laundry, utilizing the components of the described compositions, preferably in the same proportions (except for the solvent and/or dispersing medium). Additionally, especially in the solid or particulate solid compositions, a cationic antistatic agent (or antistat) may be present and such may be utilized in the invented processes to diminish static cling of washed and dried laundry.

The detergents which may be employed in accordance with the present invention include the anionic and/or nonionic detergents, with the nonionic detergent content being limited in liquid preparations to 5% of such compositions. The invented compositions may contain amphoteric detergents, such as the Miranols ®, but the content of these will normally be limited to 5% or less of the detergent composition. Similarly, cationic detergents may be present in particulate or solid compositions and sometimes may be compatible with the other components of liquid preparations but often the presence thereof will be avoided in liquid preparations because of possible objectionable reactions with anionic components thereof, such as synthetic anionic organic detergents. Some antistatic agents or antistats, which will be discussed later, also have detersive properties and so might be considered to be cationic detergents, but in this specification they will be referred to as antistatic agents or antistats, to identify their main function when they are present in the instant compositions and processes.

Of the anionic detergents the sulfated and/or sulfonated lipophilic materials having an alkyl chain of 8 to 20 carbon atoms, preferably 10 to 18 and more preferably 12 to 16 carbon atoms, will usually be those of choice. While various water soluble salt-forming cations may be used to form the desired soluble sulfated and sulfonated detergents, including ammonium and lower alkanolamine (such as triethanolamine), and magnesium, usually an alkali metal, such as sodium or potassium, is employed, and very preferably such cation will be sodium. Among the various anionic detergents that are useful in the practice of this invention are the linear higher alkylbenzene sulfonates, the monoglyceride sulfates, higher fatty alcohol sulfates, sulfated polyethoxylated higher fatty alcohols, paraffin sulfonates and olefin sulfonates, but others of this well known class may also be employed, either solely or as part of the detergent. In all of such compounds the alkyl (or acyl, for the monoglyceride sulfates) group present will be in the range of 10 or 12 to 18 carbon atoms. While some such alkyl groups may include branching they will still be of a carbon chain length within the described range. Although the mentioned anionic detergents are useful in the practice of the invention those which are considered as most useful and most effective, in combination with the polyacetal carboxylate builder and bentonite, are the sodium linear higher alkylbenzene sulfonates of 10 to 18 carbon atoms in the linear alkyl, preferably 12 to 16 carbon atoms and more preferably 12 to 14 carbon atoms, e.g., sodium linear dodecylbenzene sulfonate and sodium linear tridecylbenzene sulfonate. Also suitable anionic detergents are the sulfated polyethoxylated higher alkanols, preferably as the sodium salts, wherein such alkanols may be synthetic or natural, and which contain from 3 to 20 or 30 ethoxy groups per mole, with the higher fatty alcohol being of 12 to 18 carbon atoms, preferably averaging 12 to 15 carbon atoms or 12 to 13 carbon atoms, and with the ethoxy content being from 3 to 12, preferably 3 to 7, e.g., 3 or 5 molar proportions of ethoxy groups per mole.

The nonionic detergents, which may be employed as the primary detergents in place of the anionic detergents, especially for solid and particulate solid detergent compositions, or may be used with the anionics in the present compositions, are normally employed to only a minor extent in liquid preparations, in which the proportion thereof usually will be limited to about 5% of the composition. The nonionic detergents are preferably normally solid materials (especially when being incorporated in solid or particulate solid products) and will preferably be condensation products of ethylene oxide and a lipophile donor compound, such as higher fatty alcohol, with such group, preferably such higher fatty alcohol, usually being of 10 to 18 carbon atoms, preferably averaging 12 to 15 carbon atoms, e.g., about 12 to 13 carbon atoms, and with the ethylene oxide content being within the range of 3 to 20 moles, preferably 3 to 12 moles and more preferably 5 to 9 moles of ethylene oxide per mole of fatty alcohol, e.g., about 6.5 or 7 moles. Among other nonionic detergents that are also useful are the ethylene oxide condensation products of alkyl phenols of 5 to 12 carbon atoms in the alkyl groups, such as nonylphenol, in which the ethylene oxide content is from 3 to 30 moles per mole. Additionally, condensation products of ethylene oxide and propylene oxide, such as those sold under the trademark Pluronic ®, may be employed, as may be various others of the well known group of nonionic detergents in which a lipophilic group, such as higher alkyl, alkylphenyl or polyoxy-lower alkylene, e.g., polyoxypropylene, is joined to a polyoxyethylene ethanol by reaction with ethylene oxide.

The polyacetal carboxylate may be considered to be of the type that is described in U.S. Pat. No. 4,144,226 and may be made by the method mentioned therein. A typical such product will be of the formula

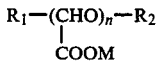

wherein M is selected from the group consisting of alkali metal, ammonium, alkyl groups of 1 to 4 carbon atoms, tetraalkylammonium gruops and alkanolamine groups, both of 1 to 4 carbon atoms in the alkyls thereof, n averages at least 6, and $R_1$ and $R_2$ are any chemically stable groups which stabilize the polymer against rapid depolymerization in alkaline solution. Preferably the polyacetal carboxylate will be one wherein M is alkali metal, e.g., sodium, $R_1$ is

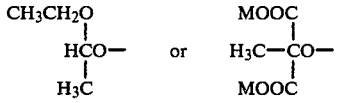

or a mixture thereof, $R_2$ is

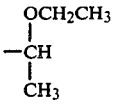

and n averages from 15 to 150, more preferably 30 to 110. The calculated weight average molecular weights of the polymers will normally be within the range of 3,000 to 20,000, preferably 3,000 to 10,000, more preferably 4,000 to 9,000, e.g., about 5,000 or 8,000.

Although the preferred polyacetal carboxylates have been described above, it is to be understood that they may be wholly or partially replaced, at least in part, by other such polyacetal carboxylates or related organic builder salts described in various Monsanto Co. patents on such compounds, processes for the manufacture thereof and compositions, if of the same molecular weights. The various chain terminating groups described in the various patents, especially U.S. Pat. No. 4,144,226, may be utilized, providing that they have the desired stabilizing properties, which allow the mentioned builders to be depolymerized in acidic media, facilitating biodegradation thereof in waste streams, but maintain their stability in alkaline media, such as washing solutions.

The bentonite employed is colloidal clay (aluminum silicate) containing montmorillonite. Montmorillonite is a hydrated aluminum silicate in which about 1/6th of the aluminum atoms may be replaced by magnesium atoms and with which varying amounts of hydrogen, sodium, potassium, calcium, magnesium and other metals may be loosely combined. The type of bentonite clay which is useful in making the invented compositions and which may be employed in the related processes is that which has a swelling capacity of at least 3 ml./g., preferably over 6 or 7 ml./g. and most preferably about 7 to 15 ml./g. It is also preferred for such bentonite to have a cation exchange capacity greater than 30 milliequivalents per gram (meq./g.), and often more than 50 meq./g. The viscosity of such a bentonite, at a 6% concentration in water, will usually be in the range of 3 to 30 centipoises and preferably will be at least 8 centipoises. Preferred swelling bentonites of this type are the Wyoming or western bentonites, which have been sold as Thixo-jels. Nos. 1, 2, 3 and 4 in the past by Georgia Kaolin Company, and which are now identified as Hi-Jells Nos. 1, etc., and are sold by the same company. Such materials include at least 3 or 4% of free moisture and usually contain no more than 8% thereof. They are insoluble in water and are of particle sizes substantially all of which pass through a No. 200 sieve, U.S. Sieve Series, and sometimes substantially all, usually 90%, 95%, 99% or more, will pass through a No. 325 sieve.

The antistat, which is preferably incorporated in the present compositions, especially the particulate compositions, to impart to them antistatic properties so that washed and dried laundry will not cling together, is normally a cationic compound and has antistatic properties. Among these, those which are preferred are di-higher alkyl di-lower alkyl ammonium halides, wherein the higher alkyls are of 10 to 18, preferably 16 to 18 carbon atoms, the lower alkyls are of 1 to 3, preferably 1 carbon atom(s) and the halogens are chlorine or bromine. Among such materials there may be mentioned distearyl dimethyl ammonium chloride, di-tallow dimethyl ammonium chloride (wherein the alkyl is obtained from animal fats) and dihydrogenated tallow dimethyl ammonium bromide. However, various other such cationic materials, including N-cetyl-ethyl morpholinium ethosulfate, which also often have deodorant and germicidal properties, may also be employed. Descriptions of the various suitable anionic and cationic detergents are given in various annual publications entitled *McCutcheon's Detergents and Emulsifiers,* for example, in that issued in 1969. Also such cationics form a well known class and are described at length in the literature (as are the anionic and nonionic detergents) and therefore such do not have to be further detailed here. An acceptable apt description of such antistats is found in British Patent No. 1,131,092, at page 18.

In the compositions of the invention other builders than the polyacetal carboxylate may also be present although such are not necessary. Often it will be desired to avoid the presence of phosphorus in the detergent compositions so the polyphosphates, which have been the builders of choice in the detergent art for many years (especially pentasodium tripolyphosphate), will preferably be omitted from the present formulations. Still, in some instances, they may be present, at least in relatively small proportions, e.g., up to 5 or 10%. Among builders other than polyphosphates such as sodium tripolyphosphate and tetrasodium pyrophosphate, those which may be desirably incorporated in the present compositions to supplement the building action of the polyacetal carboxylate include sodium silicate, zeolites, e.g., Zeolite A, NTA, sodium citrate, sodium gluconate, borax, other borates, and other builders known in the detergent art. Fillers may be present, such as sodium sulfate and sodium chloride, to add bulk to the product when that is considered to be desirable. In the preferred liquid compositons of this invention the liquid medium is a solvent and/or dispersing medium, such as water, ethanol, isopropanol, propylene glycol and/or glycerol but other such suitable liquids may also be employed. While aqueous media are preferred in many instances, especially aqueous alcoholic media, it is within the scope of the invention to utilize non-aqueous media too. Mixtures of water and other solvents and/or dispersants may be employed, as may be mixtures of non-aqueous liquids. In the liquid compositions there may be present diluents, extenders, antifreezes and adjuvants, such as buffers, thickeners, hydrotropes and stabilizers.

Among the various other adjuvants that may be employed in particulate compositions (but some can also be used in liquids) are colorants, such as dyes and pigments, perfumes, enzymes, stabilizers, activators (especially activators for causing active oxygen release from sodium perborate bleach, if present, in particulate or solid preparations), fluorescent brighteners, fungicides, germicides and any flow promoting agents. Also included among adjuvants, unless in other classes previously mentioned, are various additional components or impurities that may be present with other ingredients. For example, it is known that sodium carbonate and water are often present with polyacetal carboxylate in Builder U, the product which is the present source of polyacetal carboxylate.

Moisture will usually be present in the invented solid (including particulate) compositions, either as free moisture or in one or more hydrates. While moisture is not an essential component of these improved detergent compositions (except for the aqueous liquids) it will normally be present due to the use of water in manufacturing, and it may help to solubilize other composition components and bind them together, as is usually desired.

The proportion of total synthetic organic detergents present in the invented compositions is a detersive proportion, which may be up to 40% of the compositions but will normaly be in the range of 5 to 30 or 35%, preferably 10 to 25% and more preferably 10 to 20%, e.g., about 13, 14 or 15%. As was previously mentioned, in the liquid preparations the content of nonionic detergent will normally be limited to about 5%. In particulate detergents wherein only one type of detergent is employed the contents thereof will be the same as given for total detergents but frequently will be in the lower parts of the ranges given, such as 5 or 10 to 20%. With respect to particulate detergent compositions wherein a nonionic detergent is the principal detersive component the proportions thereof will usually be within the range of 10 to 30% and sometimes lesser upper limits will be imposed, such as 25% or 22%, so that such products, which may be made by post-addition of normally solid nonionic detergent in liquid state, will be freely flowing. When combinations of anionic and nonionic detergents are utilized the proportions thereof will generally be within the range of ratios of 1:5 to 5:1, often being in the range of 1:3 to 3:1. When mixtures of anionic detergents or mixtures of nonionic detergents are utilized the ratios thereof may vary widely, usually being within the range of 1:10 to 10:1.

The polyacetal carboxylate component will usually be present in a proportion from 5 to 40%, preferably 15 to 35% and more preferably 17 to 25%, e.g., 20 or 21%. In liquid detergent preparations, to avoid producing a product which will not flow sufficiently quickly, as a practical matter the upper limit of polyacetal carboxylate content may be about 30% in some instances. The percentage of bentonite in the present compositions will usually be in the range of 3 to 25%, preferably being 5 to 20% and more preferably being 5 to 12%, e.g., about 8 or 10%. In liquid preparations the proportion of bentonite may be adjusted within the ranges given so as better to stabilize such preparations against separation out of the polyacetal carboxylate powder. In such liquid preparations both the polyacetal carboxylate and the bentonite will normally be in finely divided powder form, such as powders which will be in the size range of Nos. 100 to 400 sieves, often passing through 200 or 325 mesh sieves. Of course, for particulate preparations, it is preferred that the particle sizes of components should be like those of the desired final composition, if the particular component is separately incorporated in the composition, although more finely divided powders are also useful, as has been indicated. The ratio of the proportion of synthetic organic detergent to polyacetal carboxylate will normally be within the range of 1:4 to 2:1, preferably being in the range from 1:2 to 1:1, and the ratio of bentonite to polyacetal carboxylate will normally be in the range of 1:5 to 1:1, preferably 1:3 to 2:3.

The moisture content of the solid compositions of the invention will usually be in the range of 2 to 20%, preferably 5 to 15%, e.g., about 10%, and the liquid content of the liquid detergents will usually be from 30 to 70%, preferably 43 to 68%, e.g., about 53 or 58%. In many instances such percentages apply to water as the sole liquid present in the liquid compositions but often a co-solvent, such as isopropanol and/or ethanol, is/are present and in such instances the ratio of water to co-solvent total will preferably be within the range of 1:1 to 10:1. Lesser proportions of liquid medium will be utilized for cream and paste forms of the invention, with still lower proportions being in films, briquettes, pellets, bars and cakes.

The optional cationic antistatic agent will normally be present in an antistatic proportion in the range of 2 to 10%, preferably 4 to 6%, e.g., about 5% and the proportions of builders other than polyacetal carboxylate, if such are present, will be in the range of 5 to 30%, often with from 5 to 20% of sodium carbonate being present, preferably 5 to 15% thereof, and 3 to 15% of sodium silicate being in the formula, preferably 5 to 12%. Total adjuvants will usually not exceed 20%, preferably being 10% or less, and individual adjuvants will usually be limited to 5%, preferably 3% and more preferably about 1%, in many cases.

The manufacture of the present compositions may be conducted in any suitable conventional manner, depending on whether solid, liquid, paste or other types of products are being made. For liquid products the liquid medium, which may be a solvent, dispersant, or other functional material, or a mixture, may have the various components added to it, usually preferably with any hydrotrope being added first, followed by detergent, polyacetal carboxylate, bentonite and antistat, if present. However, admixing may be effected simultaneously or in other sequences, too. Normally any colorants and perfumes will be added near the end of the manufacturing procedure. In some instances it may be desirable to withhold some of the solvent for final addition, whereby a final thinning of the mix may be obtained, when desired. Various types of mixers may be employed and in some instances utilization of homogenizing mixers may be preferred. Instead of the liquid form, with viscosities in the readily flowable range, normally ranging from 10 centipoises to 10,000 centipoises, such as 50 or a thousand to 10,000 cp., e.g., about 2,000 or 6,000 cp., higher viscosity liquids and non-flowable products may be produced in the same general manner, modifying the proportions of components present and changing the mixing equipment employed accordingly. The viscosity measurements given are approximate and it must be kept in mind that because the present compositions are somewhat thixotropic they can be thinned by stirring or shaking so that even if initially difficult to pour, pouring can be effected after such agitation.

To make the preferred particulate solid compositions, which will usually be of particle sizes in the 8 to 120 or 10 to 100 sieve (U.S. Sieve Series) range, it will often be preferred to spray dry as much of the formulation as is feasible, so as to obtain substantially uniformly shaped globular particles. Because the polyacetal carboxylate of the present compositions can be adversely affected by heat it may be desired to post-add it to other components of the product that have previously been spray dried to form what may be referred to as "base" beads. If the polyacetal carboxylate is to be post-added it will be preferred that it be of essentially the same shapes, particle sizes and approximate bulk density as the rest of the composition, so as to inhibit segregations during shipping and storage. However, even if more finely divided powdered polyacetal carboxylate is employed, such as that of particle sizes in the 100 or 160 to 200 or 325 mesh (or sieve number) range, or smaller, one finds that such particles will often adhere to the larger beads, maintain the product in the desired size range and be essentially non-segregating (although, of course, results will not be as good in this respect as when the various components of the composition are all of the same sizes, shapes and bulk density).

If the polyacetal carboxylate is spray dried with the detergent composition care will be exercised to prevent its decomposition due to its exposure to high spray tower drying air temperatures. When spray drying is unavailable or when costs are to be minimized the various commponents of the present compositions may be mixed together, as powders, and may be agglomerated to the desired 10 to 100, sieve size, or they may be mixed together as fine powders, usually in the 100 or 160 to 200 to 325 mesh range. When a nonionic detergent is to be present in the product in a significant proportion the major proportion thereof may be post-sprayed onto previously spray dried beads or onto particles of other components of the composition. Normally, no more than about 4% of nonionic detergent, on a final product basis, will be in a spray dried product, unless added after spray drying, due to decomposition of the nonionic detergent that can occur at elevated tower temperatures when more than a relatively small proportion thereof is present in the crutcher slurry being spray dried. Other temperature sensitive components of the product may also be post-added so as to avoid undesirable subjections to elevated temperatures. Thus, if a bleaching agent, such as sodium perborate, is to be present in the formulation, it will be post-added, as will be enzyme powder, antistat, perfume and other heat sensitive components, preferably as particles in the previously mentioned final desired range, or as finely divided powders of sizes previously given. Finer particles, e.g., through Nos. 200 and 325 sieves, may also be used. Materials like bentonite, the inorganic builders, such as sodium carbonate, sodium bicarbonate, sodium silicate and zeolites, and fillers, such as sodium sulfate, help to make strong, attractive and free flowing spray dried beads and preferably will be incorporated in crutcher slurries to be spray dried for their physical characteristics, as well for their building and filling functions.

In the practice of the washing process of this invention, wherein soiled (and stained) fibrous materials, such as conventional clothing and "laundry" fabrics, of cotton, polyester-cotton blends, polyesters, acrylics, nylons, acetates, rayons and various blends thereof, are washed in an aqueous washing medium, such medium will contain a suitable detergent, as described, a polyacetal carboxylate of the desired calculated weight average molecular weight, and bentonite of the type indicated. Preferably such components will be part of a liquid or particulate solid detergent composition but it is within the invention to charge such materials separately to the wash water. The wash water may be of any suitable type, with a medium hardness water often being preferred. However, the hardness of the water may range from 0 to 400 p.p.m. or so, normally being from 50 to 200 or 300 p.p.m., with the range of 50 to 150 p.p.m. often being preferred, e.g., 100 p.p.m. The water temperature is preferably in the range of 30° to 60° C. but other temperatures, as low as 5° to 10° C. and as high as 70° C., and in some cases 90° C., may be employed. Washing may be by hand, with hand rinsing and line drying, or may be by automatic washing machine, which includes one or more automatic rinse cycles, followed by automatic drying. The water hardness will preferably be mixed calcium and magnesium hardness, usually being within the range of 1:1 to 10:1, e.g., 3:2 to 4:1, of calcium to magnesium.

In the wash waters the total proportions of the present compositions employed will normally be within the range of 0.05 to 0.5%, preferably 0.1 to 0.3% and more preferably about 0.15%. From the upper and lower limits of such ranges it is seen that the percentages of detergent in the wash water will normally be from 0.0025 to 0.15%, preferably being 0.005 to 0.125% and more preferably being 0.01 to 0.04%. When a liquid detergent is employed the percentage of nonionic detergent in the wash water will usually be in the range of 0.000 to 0.025%, in a preferred method of the invention, with anionic detergent being the balance.

The percentage ranges of polyacetal carboxylate and bentonite in the wash water will normally be 0.0025 to 0.2% and 0.0015 to 0.125%, preferably 0.0075 to 0.075% and 0.0025 to 0.100%, and more preferably 0.017 to 0.05% and 0.005 to 0.024%, respectively. When an antistat is present the percentage thereof in the wash water will normally be from 0.002 to 0.02%, preferably 0.004 to 0.01%. The proportion of other components can be calculated from the proportions thereof previously recited for the invented compositions and the concentrations of such compositions recommended for use in washing.

The invented compositions and washing processes possess significant and unexpectedly beneficial advantages over the prior art softening detergent compositions and methods. The polyacetal carboxylate allows the manufacture of a satisfactory built synthetic organic detergent composition which is free of phosphorus or in which the phosphorus content can be minimized. The builder in such compositions is non-eutrophying and is readily biodegradable or hydrolyzable to carbon, hydrogen and oxygen compounds which are relatively innocuous. Yet, the builder is sufficiently stable to be effective in washing operations. The bentonite softener is compatible with anionic synthetic organic detergents and helps to stabilize liquid compositions containing polyacetal carboxylate builder. Surprisingly the combination of anionic and/or nonionic detergent, polyacetal carboxylate builder for such detergent and bentonite fabric softener results in improved fabric softening, compared to compositions wherein the polyacetal carboxylate is replaced by the previous standard for builder excellence in the detergent field, pentasodium tripolyphosphate. Additionally, in the liquid preparations the polyacetal carboxylate is more suspendable than sodium tripolyphosphate so the liquid detergents are more stable against undesired settling out of the builder. The various advantages cited are considered to be unexpectedly beneficial and unobvious and represent significant advances in the art. de The following examples illustrate the invention but do not limit it. Unless otherwise indicated, all parts are by weight and all temperatures are in °C. in the examples, the specification and the claims.

EXAMPLE 1

| Component | Percent |
|---|---|
| Sodium linear dodecylbenzene sulfonate | 13 |
| Builder U (Lot 2538422, of molecular weight of 8034, 79.7% active polymer and 4.2% of sodium carbonate, with the balance being mostly water, obtainable from Monsanto Company) | 21 |
| Bentonite (Hi-Jell No. 1, a high swelling western bentonite of a swelling capacity in the range of 7 to 15 ml./g., obtainable from Georgia Kaolin Co.) | 8 |

-continued

| Component | Percent |
|---|---|
| Water, deionized | 58 |
| | 100 |

A liquid detergent of the above formula is made by sequentially adding to a major proportion of the water the detergent, builder and fabric softening material, and subsequently admixing the balance of the water (about 12% of the composition). Such product is then tested for its detersive and softening characteristics. It is found to be a satisfactory detergent, on a par with commercial built synthetic organic detergent compositions. With respect to softening the test employed is one wherein the wash water is of a hardness of 100 p.p.m., as calcium carbonate (3:2 Mg:Ca hardness ratio) and is at a temperature of 49° C. Two face cloths of cotton (or terrycloth) are washed in a General Electric Company automatic washing machine for ten minutes, with the wash water being of a detergent composition concentration of 0.18%, followed by rinsing and drying in an automatic laundry dryer. They are then rated by an expert in fabric softness evaluations, for softness, using a standard scale of 1 to 10, wherein 1 indicates no softness and 10 indicates excellent softness produced by the treating composition. A softness rating of 9 is awarded to the invented composition.

Essentially the same result is obtained when an equal concentration of another sodium polyacetal carboxylate (Builder U, Lot 2547312) is used, which has a molecular weight of 5250. However, when the experiment is repeated but the Builder U is replaced by pentasodium tripolyphosphate the softness rating is reduced to 6. Such differences are readily ascertainable by the consumer and are considered to be significant.

The liquid detergent composition made is readily pourable through a narrow necked bottle (2 cm. diameter circular opening) and is stable at room temperature for at least several months, after which it has thickened somewhat but is still pourable, especially after shaking. On the contrary, the "control" composition, including sodium tripolyphosphate instead of Builder U, is less stable and more apt to separate, with the phosphate falling to the bottom of the container.

To raise the softening power of the polyphosphate control composition to the level to the experimental composition it will be required to increase the bentonite content to approximately twice its concentration in the experimental formula, which, as a practical matter, is unacceptable, and in some cases could lead to production of a detergent composition which would not have the cleaning properties or the physical characteristics desired, and which would also be more expensive to manufacture.

When the various components of the experimental and control formulas are increased 20%, replacing equal weights of water, pourable liquid detergent compositions result which also exhibit the improved softening for the experimental formula over the control. Such favorable results are also obtained when the concentrations of the compositions are in the 0.1 to 0.3% range in the wash water, e.g., 0.1, 0.15 and 0.25%, at hardnesses of 50 and 200 p.p.m. and at 20° and 35° C.

When the preceding experiments are repeated with the individual components being added to the wash water, except for the deionized water, essentially the same results are obtained. Also, when the anionic detergent content is reduced to 10%, and 3% of Neodol 23-6.5 or other nonionic detergent is added the same type of fabric softening difference results.

EXAMPLE 2

The experiments of Example 1 are repeated, utilizing mixtures of the three essential components of the invention in the proportions indicated, with sodium sulfate (anhydrous) replacing the deionized water. The product resulting, a powder, is of particle sizes of about 160 to 200 mesh. When subjected to washing and softening test procedures like those of Example 1 the experimental formulas and the controls are both acceptable with respect to detergency but the experimental formulas are noticeably better in softening the face cloths. Similar results are also obtainable when instead of cotton or cotton-polyester cloths there are employed fabrics of other compositions, including the synthetics and cotton-synthetic blends (polyesters, nylons, acrylics and acetates).

When the described formulas of this example are spray dried from aqueous crutcher mixes of 55% solids content at a temperature of 55° C. to produce particles in the 10 to 100 sieve size range the same testing yields essentially the same results. This is also so when 30% (composition basis) of the sodium sulfate of such product is replaced by 10% of sodium carbonate, 10% of sodium silicate ($Na_2O:SiO_2=1:2.4$) and 10% of moisture, and also when the anionic detergent is replaced by sodium linear tridecylbenzene sulfonate, sodium lauryl sulfate, sodium cocomonoglyceride sulfate or Neodol 25-7 (post-added) or when partial replacements ($\frac{1}{2}$, $\frac{1}{3}$ or 1/10) are made.

When the form of the product is changed, by compaction, extrusion, agglomeration or other such process or by changing the proportion of liquid medium, so that agglomerates, cakes, bars, briquettes, films or pastes are produced such products also yield the same comparative improvements in softening power when of the invented formulas, compared to controls.

EXAMPLE 3

The experiments reported in Example 2 that relate to the manufacture of solid or particulate solid products are modified by replacing some sodium sulfate filler with distearyl dimethyl ammonium chloride so that the compositions contain 5% thereof. The improved fabric softening previously noted with respect to the controls is still observed and the products made are noticeably less susceptible to electrostatic charge accumulation, with the result that the washed materials, especially those of synthetic organic polymers, do not cling together. Such results are also obtainable with others of the cationic antistats, and when the proportions thereof that are present are 3% and 7%.

When the liquid compositions of Example 1 have a portion of the water thereof (10% on a composition basis) replaced by another liquid medium material, such as ethanol or glycerol, and when adjuvants such as sodium xylene sulfonate (3%), sodium carboxymethyl cellulose (1%), fluorescent brightener (1%), and perfume (0.5%) are also incorporated in the formula, replacing equal weights of water, the products resulting exhibit the same relative improvements in softening characteristics for the experimental formulas, compared to the controls. The experimental products will also be more stable, with less settling out of the polyacetal carboxylate, compared to the polyphosphate builder. In some instances, the liquid medium for the liquid detergent may be non-aqueous, e.g., polypropylene glycol, in which case similar results are obtainable.

EXAMPLE 4

The various proportions of components given for the formulas and wash waters of Examples 1–3 are varied ±10% and ±30%, maintaining such within the ranges previously taught. Similarly, the concentrations in the wash water are varied proportionately. Results indicate that significantly better softening is obtained for the experimental formulas than for the controls, and for the liquid products the experimental compositions are of better stability.

The invention has been described with respect to various illustrations and examples thereof but is not to be limited to these because it is evident that one of skill in the art, with the present specification before him or her, will be able to utilize substitutes and equivalents without departing from the invention.

What is claimed is:

1. A fabric softening built detergent composition comprising a detersive proportion, within the range of 5 to 30%, of a synthetic organic detergent selected from the group consisting of anionic detergents, nonionic detergents, and mixtures thereof, a building proportion, within the range of 5 to 40%, of polyacetal carboxylate builder for such detergent(s), which is of calculated weight average molecular weight in the range of about 3,000 to 20,000, and a fabric softening proportion within the range of 3 to 25%, of bentonite, in which detergent composition the fabric softening activity is greater than that attributable to the bentonite.

2. A detergent composition according to claim 1 which comprises an antistatic proportion of a quaternary ammonium compound which is a cationic antistatic agent which, upon washing of fabrics of synthetic organic polymers, inhibits development of static cling during automatic laundry drying.

3. A detergent composition according to claim 1 wherein the anionic detergent is a sulfated and/or sulfonated detergent or a mixture thereof, the nonionic detergent is a higher alcohol polyethoxylate, an alkylphenol polyethoxylate or a condensation polymer of ethylene oxide and propylene oxide, the polyacetal carboxylate polymer is linear and includes about 15 to 150 polyacetal carboxylate units in the chain thereof, and the bentonite is one having a swelling capacity of at least 3 ml./g.

4. A liquid detergent composition according to claim 3 which comprises a liquid solvent and/or dispersing medium, and in which liquid detergent composition the anionic detergent is a sulfated and/or a sulfonated detergent having a higher linear alkyl or higher linear acyl lipophilic moiety and is an alkali metal salt, the nonionic detergent is a condensation product of a higher fatty alcohol of 10 to 18 carbon atoms and 3 to 20 ethylene oxide groups, the polyacetal carboxylate polymer is linear and includes about 30 to 120 polyacetal carboxylate units in the chain thereof and the anion of the carboxylate is alkali metal, the bentonite is of a swelling capacity of at least 6 ml./g. and the proportions of anionic detergent, nonionic detergent, polyacetal carboxylate, bentonite and solvent and/or dispersant are in the ranges of 10 to 25%, 0 to 5%, 15 to 35%, 5 to 20% and 30 to 70%, respectively.

5. A liquid detergent composition according to claim 4 wherein the aqueous medium is selected from the group consisting of water, ethanol, isopropanol, glycerol and polyethylene glycol, and mixtures thereof.

6. A liquid detergent composition according to claim 5 wherein the synthetic organic detergent is a sodium linear higher alkylbenzene sulfonate in which the alkyl is of 10 to 18 carbon atoms, the polyacetal carboxylate is of a calculated weight average molecular weight in the range of 3,000 to 10,000 and the linear polymer is of about 30 to 110 polyacetal carboxylate units in the chain, and the bentonite is of a swelling capacity in the range of 7 to 15 g./ml, and the proportions of sodium linear alkylbenzene sulfonate, polyacetal carboxylate, bentonite and liquid medium are 10 to 20%, 17 to 25%, 5 to 12% and 43 to 68%, respectively.

7. A liquid detergent composition according to claim 6 wherein the synthetic organic detergent is sodium linear higher dodecylbenzene sulfonate, the polyacetal carboxylate is of a calculated weight average molecular weight of about 8,000, the bentonite is a western bentonite having a cation exchange capacity greater than 50 milliequivalents per 100 grams and the liquid medium is water, and the proportions of detergent, polyacetal carboxylate, bentonite and water are about 14%, 20%, 10% and 53%, respectively.

8. A method of simultaneously washing and softening fabric materials which comprises washing such materials in an automatic washing machine for a period from 2 to 30 minutes in wash water at a temperature in the range of 10° to 70° C. and of a water hardness in the range of 0 to 300 p.p.m., as calcium carbonate, in which wash water there is present a detersive proportion, within the range of 0.0025 to 0.15%, of a synthetic organic detergent selected from the group consisting of anionic detergents, nonionic detergents, and mixtures thereof, a building proportion, within the range of 0.0025 to 0.2% of polyacetal carboxylate of calculated weight average molecular weight in the range of 3,000 to 20,000, and a fabric softening proportion, within the range of 0.0015 to 0.125%, of bentonite, rinsing the materials and drying them, by which method the fabric softening activity of the wash water on the fabric material is greater than that attributable to the bentonite content of the wash water.

9. A method according to claim 8 wherein the wash water is of a hardness in the range of 50 to 150 p.p.m., as calcium carbonate, is at a temperature in the range of 30° to 60° C. and includes 0.005 to 0.125% of anionic detergent which is a sulfated and/or sulfonated detergent having a higher linear alkyl or higher linear acyl lipophilic moiety and which is an alkali metal salt, 0.000 to 0.025% of a nonionic detergent which is a condensation product of a higher fatty alcohol of 10 to 18 carbon atoms and 3 to 20 ethylene oxide groups, 0.0075 to 0.175% of a linear polyacetal carboxylate polymer of about 30 to 120 polyacetal carboxylate units in the chain thereof and of a calculated weight average molecular weight in the range of 3,000 to 10,000, and 0.0025 to 0.100% of bentonite, which has a swelling capacity of at least 3 ml./g., and drying of the washed materials is by automatic laundry dryer drying or line drying.

10. A method according to claim 9 wherein the synthetic organic detergent is sodium linear higher alkylbenzene sulfonate in which the alkyl is of 12 to 14 carbon atoms, the polyacetal carboxylate is of a calculated weight average molecular weight in the range of 4,000 to 9,000 and the bentonite has a swelling capacity in the range of 7 to 15 ml./g. and the concentrations of such components in the wash water are in the ranges of 0.01 to 0.04%, 0.017 to 0.05%, and 0.005 to 0.024%, respectively.

11. A method according to claim 10 wherein the wash water comprises from 0.002 to 0.02% of distearyl dimethyl ammonium chloride, as an antistat.

* * * * *